US011078820B2

(12) United States Patent
Niedmann et al.

(10) Patent No.: US 11,078,820 B2
(45) Date of Patent: Aug. 3, 2021

(54) METHOD FOR PRODUCING A HONEYCOMB STRUCTURE

(71) Applicant: Continental Automotive GmbH, Hannover (DE)

(72) Inventors: Alf Niedmann, Neunkirchen-Seelscheld (DE); Emmanuel Kraus, Lohmar (DE); Alexander Möseler, Hennef-Bröl (DE); Ferdi Kurth, Mechernich (DE); Harald Kraus, Troisdorf (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 433 days.

(21) Appl. No.: 16/305,642

(22) PCT Filed: May 24, 2017

(86) PCT No.: PCT/EP2017/062599

§ 371 (c)(1),
(2) Date: Nov. 29, 2018

(87) PCT Pub. No.: WO2017/211592

PCT Pub. Date: Dec. 14, 2017

(65) Prior Publication Data

US 2020/0340385 A1 Oct. 29, 2020

(30) Foreign Application Priority Data

Jun. 9, 2016 (DE) ..... 10 2016 210 235.4

(51) Int. Cl.
*F01N 3/28* (2006.01)
*F01N 3/20* (2006.01)

(52) U.S. Cl.
CPC ..... *F01N 3/281* (2013.01); *F01N 3/2026* (2013.01); *F01N 3/2842* (2013.01); *F01N 2330/04* (2013.01); *F01N 2330/44* (2013.01)

(58) Field of Classification Search
CPC .... F01N 3/281; F01N 3/2026; F01N 2330/04; F01N 2330/44
(Continued)

(56) References Cited

U.S. PATENT DOCUMENTS 4,891,257 A 1/1990 Humpolik et al.
5,140,812 A * 8/1992 Cornelison ..... F01N 3/281 60/300
(Continued)

FOREIGN PATENT DOCUMENTS

CN 1175992 3/1998
CN 1653249 8/2005
(Continued)

OTHER PUBLICATIONS

Notice of Allowance dated Mar. 31, 2020 issued in Korean Patent Application No. 10-2018-7035493.

*Primary Examiner* — Tom P Duong
(74) *Attorney, Agent, or Firm* — Cozen O'Connor

(57) ABSTRACT

A method for producing a honeycomb structure having at least one at least partially structured metal foil, such that, in subregions of the honeycomb structure, a portion of the at least one metal foil is arranged spaced apart from an adjacently arranged portion of the at least one metal foil so as to be electrically insulated by an air gap therebetween, includes: providing the at least one metal foil; providing a forming plate having a bearing surface and having at least one first web structure extending from the bearing surface in an axial direction, the first web structure extending in a plane parallel to the bearing surface and defining the air gap to be produced in the honeycomb structure; and arranging the at least one metal foil on the bearing surface in the first web structure.

10 Claims, 2 Drawing Sheets

(58) Field of Classification Search
USPC ..... 428/598
See application file for complete search history.

(56) References Cited

U.S. PATENT DOCUMENTS

| | | | | |
|---|---|---|---|---|
| 5,272,876 | A * | 12/1993 | Sheller | B01J 35/04 60/300 |
| 5,411,711 | A * | 5/1995 | Swars | F01N 13/009 422/177 |
| 5,456,890 | A * | 10/1995 | Tsai | F01N 3/2842 422/174 |
| 5,651,906 | A * | 7/1997 | Whittenberger | B01J 35/0033 219/552 |
| 5,865,864 | A | 2/1999 | Brück | |
| 6,029,488 | A * | 2/2000 | Wieres | B01J 35/04 29/890 |
| 6,226,867 | B1 | 5/2001 | Brück et al. | |
| 6,562,305 | B1 * | 5/2003 | Swars | F01N 3/2853 422/174 |
| 7,476,366 | B2 * | 1/2009 | Maus | F01N 3/281 422/168 |
| 8,761,586 | B2 | 6/2014 | Brück | |
| 9,623,373 | B2 | 4/2017 | Brueck et al. | |
| 2006/0191982 | A1 * | 8/2006 | Bruck | B01J 35/04 228/181 |
| 2008/0182066 | A1 * | 7/2008 | Voit | B21D 11/06 428/116 |
| 2008/0217315 | A1 * | 9/2008 | Bruck | F01N 3/2026 219/162 |
| 2011/0120069 | A1 * | 5/2011 | Maus | F01N 3/281 55/521 |
| 2014/0373513 | A1 * | 12/2014 | Hirth | B01D 53/94 60/297 |

FOREIGN PATENT DOCUMENTS

| | | | |
|---|---|---|---|
| CN | 104053876 | | 9/2014 |
| CN | 104364483 | | 2/2015 |
| CN | 105464766 | A | 4/2016 |
| DE | 197 04 521 | A1 | 8/1998 |
| DE | 10 2004 033 985 | A1 | 2/2006 |
| DE | 196 80 093 | B4 | 8/2006 |
| DE | 10 2007 010 758 | A1 | 9/2008 |
| EP | 0218062 | | 4/1987 |
| JP | H 05-509037 | | 12/1993 |
| JP | H09174179 | A | 7/1997 |
| JP | H 11-508814 | | 8/1999 |
| JP | 2015-504780 | | 2/2015 |
| KR | 1020010023630 | | 3/2001 |
| KR | 1020100125329 | | 11/2010 |
| WO | WO 2013/150066 | | 10/2013 |

* cited by examiner

METHOD FOR PRODUCING A HONEYCOMB STRUCTURE

CROSS-REFERENCE TO RELATED APPLICATIONS

This is a U.S. national stage of application No. PCT/EP2017/062599 filed on 24 May 2017, which claims priority to the Germany Application No 10 2016 210 235.4 filed 3 Jun. 2016, and the content of all incorporated herein by reference.

BACKGROUND OP THE INVENTION

1. Field of the Invention

The present invention relates to a method for producing a honeycomb structure.

2. Related Art

The honeycomb structure has one or more air gaps, which extend along an axial direction, in particular from one end side to the other end side, wherein metal foils arranged adjacent to one another are arranged so as to be electrically insulated by the air gap. The air gap additionally also extends through the honeycomb structure in a circumferential direction and/or in a radial direction. The air gap serves for example for the electrical insulation in an electrically heated honeycomb body. The course of a current path through the honeycomb body is predefined at least partially by the air gap. Such electrically heated honeycomb bodies with an air gap are known for example from WO 2013/150066 A1.

In the prior art, for the purpose of introducing an air gap into a honeycomb structure, oxidized smooth and corrugated foils (oxidized, at least partially structured metal foils) have also been wound into the honeycomb structure, with these then being removed from the honeycomb structure again following the soldering process.

In this case, owing to the elastic stacking of the metal foils, there may be a non-uniform load distribution in the honeycomb structure, which can lead to a negative soldering quality (absence of a connection of metal foils arranged adjacent to one another). Also, when removing these metal, foils, producing the air gap, from the honeycomb structure following the soldering process, the honeycomb structure can be damaged, with the result that repair measures or re-manufacturing of the honeycomb structure become necessary. Furthermore, the removal of these metal foils is very time-consuming and is not able to be carried out in a reproducible manner. Automation of the production process is thus possible only with difficulty. The removed metal foils are not able to be re-used and are disposed of as scrap.

SUMMARY OF THE INVENTION

It is therefore an object of the invention to at least partly solve the problems described with regard to the prior art, and in particular to provide a method for producing a honeycomb structure with an air gap, in which method uniform preloading in the honeycomb structure is ensured prior to and during a connection process, destruction of the means for producing the air gap is avoided, the process is made automatable and re-use of the means used for producing the air gap is made possible.

The honeycomb structure is formed in particular by at least one at least partially structured metal foil, which, for the purpose of producing the honeycomb structure, is stacked and/or wound and/or twisted. The honeycomb structure at least partially has flow ducts by way of which a fluid can flow through the honeycomb structure from a first end side to a second end side. "Partially structured" means that the metal foil is partially of smooth form, and partially formed with for example sinusoidal corrugations, with holes, with diverting structures or the like. The honeycomb structure is preferably used for treating exhaust gas, in particular exhaust gas of an internal combustion engine in a motor vehicle, for example a passenger motor vehicle, a heavy goods vehicle, a ship or an aircraft.

The objects may be achieved by a method as set forth below. It should be pointed out that the features specified individually may be combined with one another in a technologically meaningful way and define further configurations of the invention. Furthermore, the features specified in the patent claims are rendered more precisely and explained in more detail in the description, with further preferred configurations of the invention being presented.

In accordance with one aspect of the present invention, a method for producing a honeycomb structure having at least one at least partially structured metal foil is provided, wherein, in subregions of the honeycomb structure, the metal foil is arranged spaced apart from an adjacently arranged metal foil so as to be electrically insulated by an air gap, at least including the following steps:

a. providing the at least one metal foil;
b. providing a forming plate with a bearing surface and with at least one first web structure extending from the bearing surface in an axial direction, wherein the first web structure also extends in a plane parallel to the bearing surface and images the air gap to be produced in the honeycomb structure; and
c. arranging the at least one metal foil on the bearing surface in the first web structure.

In relation to the function and arrangement of an air gap for insulating metal foils and for guiding a current path through a honeycomb structure, reference is made to WO 2013/150056 A1, which was mentioned in the introduction and the entirety of which is hereby incorporated by reference.

A forming plate having a first web structure is therefore proposed. The forming plate and, in particular, the first web structure are produced from a temperature-resistant material, for example a steel alloy, a ceramic or the like. The web structure preferably forms in the honeycomb structure in the finished state (that is to say also for example which has undergone connection by way of a soldering process) the air gap to be produced. To this end, the first web structure has, proceeding from a bearing surface of the forming plate, a height in the axial direction such that the metal foils to be arranged in the first web structure are able to sink into the first web structure far enough so that a fixed air gap is able to be produced with constant width along the axial direction. The first web structure extends in particular in the axial direction with preferably constant height. Furthermore, the web structure extends in a plane parallel to the bearing surface, that is, transverse to the axial direction, in particular in a spiral-shaped manner. The web structure thus allows a current path to be predefined in the honeycomb structure.

In step c., the at least one metal foil is arranged on the bearing surface and within the first web structure, that is, between the walls of the first web structure.

In a further step d., the forming plate is sent, together with the at least one metal foil, to a connection step in which interconnection of the at least one metal foil is realized for the permanent formation of the honeycomb structure, wherein, in a following step e., the forming plate with the first web structure is removed from the honeycomb structure.

The connection step comprises in particular a soldering process, preferably a soldering process in which, at temperatures of 800 to 1200° C. [degrees Celsius], a solder material is melted and the adjacently and mutually abutting metal foils are interconnected at positions provided for this purpose. The soldering process is known for producing the honeycomb bodies described here.

According to a preferred refinement, the forming plate has a plurality of first openings that, extend through the forming plate in the axial direction, wherein a support pin is able to be passed through at least one of the first openings for the purpose of arrangement in the honeycomb structure according to step c.

The support pin serves, in particular, for spacing-apart from, and for fixing of the honeycomb structure by, a so-called supporting honeycomb body, which is arrangeable downstream or upstream of the honeycomb structure in a fluid (exhaust gas) line.

Here, the support pin is used in particular only for controlling the location/position of the produced honeycomb structure. It can thus be ensured for subsequent process steps that the honeycomb structure is connectable in a reproducible manner to other supporting honeycomb structures.

In particular, in step c. of the method, use is additionally made of a winding spiral that has a spiral-shaped second web structure that corresponds to the first web structure, wherein the second web structure terminates in a flush manner in the axial direction at a first end side facing the forming plate, wherein the second web structure has a pitch at the second end side, wherein, proceeding from a center of the second web structure, the second end side continuously approaches the first end side along the spiral-shaped windings, and wherein the winding spiral has at least two pins, which extend further along the axial direction proceeding from the center, wherein the at least one metal foil is received between the two pins and, by rotation of the winding spiral, continuously received into the second web structure and then transferred into the first web structure.

The winding spiral in particular allows automated arrangement of the at least one metal foil in the first web structure. This process is explained precisely in the description of the figures below. Proceeding from a first end side of the winding spiral, which side faces the forming plate and the first web structure arranged thereon, a second web structure extends in a spiral-shaped manner, on the one hand along a circumferential direction and in a radial direction from the outside inward, and on the other hand with each winding in the axial direction too. Here, the (complete) second web structure terminates in a flush manner at the first end side, wherein the second web structure extends with a pitch progressively along the axial direction at the second end side, with the result that a center at the second end side of the second web structure is arranged at a maximum distance from the first end side. The pitch of the spiral second web structure makes it possible that, during rotation of the winding spiral, the one metal foil (or the stack of metal foils) is gradually wound in a spiral proceeding from the center, and an increasing number of windings (proceeding from an innermost winding at the center to an outermost winding) are received in the second web structure.

In this case, the second web structure likewise forms the predetermined air gaps in the honeycomb structure. The second web structure corresponds at least substantially to the form of the first web structure (in a plane transverse to the axial direction). Consequently, the at least one metal foil can be transferred from the winding spiral into the first web structure of the forming plate along the axial direction, and the winding spiral can continue to be used for the next winding process.

In particular, the winding spiral has driving pins which extend from the second web structure at the first end side and which extend into second openings in the first web structure and/or in the forming plate and/or into first openings in the forming plate.

The driving pins in particular ensure an aligned arrangement of the first web structure and the second web structure. Furthermore, it is thus possible to couple the rotational movement of the forming plate and winding spiral for winding the at least one metal foil.

It is furthermore proposed that, in step c., use is also made of a winding plate which has a slot extending in a spiral-shaped manner and corresponding to the second web structure, wherein, during the rotation of the winding spiral, the winding spiral sinks into the slot with the second web structure and starting with the center, and thus the at least one metal foil, arranged between the winding plate end the winding spiral, is, along the axial direction, gradually introduced into the winding spiral and, finally, transferred into the first web structure.

The winding plate is, in particular, of planar form, with the result that the at least, one metal foil is preferably guided in its entire extent along the axial direction.

In particular, the movement along the axial direction is coupled to, and/or synchronized with, the rotation of the winding place and forming plate.

According to a preferred configuration, prior to being arranged in the first web structure, the at least one at least partially structured metal foil forms a multi-layered stack. In particular, one metal foil is folded multiple times for the purpose of forming a stack. However, it is also possible for multiple, in particular differently structured (or at least partially non-structured, that is to say substantially smooth), metal foils to be arranged one on top of the other to form a stack.

Also proposed is a winding device for implementing a method according to the invention, at least comprising a forming plate with a first web structure.

In particular, the winding device furthermore comprises at least one winding spiral with a second web structure, and a winding plate.

BRIEF DESCRIPTION OF THE DRAWINGS

The invention and the technical field will be explained in more detail below on the basis of the figures. It should be pointed out that the figures show particularly preferred embodiment variants of the invention, to which the invention is however not restricted. Here, identical components in the figures are denoted by the same reference signs. In the figures, in each case schematically.

DETAILED DESCRIPTION OP THE PRESENTLY PREFERRED EMBODIMENTS

Figure 1:
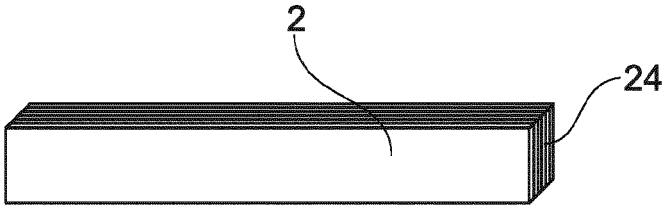
FIG. 1 shows a stack of metal foils in a perspective view.

FIG. 1 shows a stack 24 of metal foils 2 in a perspective view, and the method step a.

Figure 2:
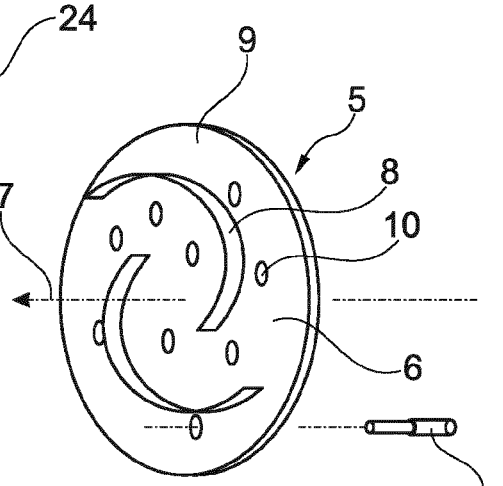
FIG. 2 shows a forming plate in a perspective view.

FIG. 2 shows a forming plate 5 in a perspective view, and the method step b. The forming plate 5 has a first web structure 8. The first web structure 8 forms in the honeycomb structure 1 in the finished state (that is to say also for example which has undergone connection by way of a soldering process) the air gap 4 to be produced (see FIG. 4). To this end, the first web structure 8 has, proceeding from the bearing surface 6 of the forming plate 5, a height in the axial direction 7 such that the metal foils 2 to be arranged in the first web structure 8 are able to sink into the first web structure 8 far enough so chat a fixed air gap 4 is able to be produced with constant width along the axial direction 7 (see FIG. 3). The first web structure 8 extends in a plane S parallel to the bearing surface 6, that is to say transverse to the axial direction 7. The first web structure 8 thus allows a current path to be predefined in the honeycomb structure 1. The forming plate 5 furthermore has a plurality of first openings 10, which extend through the forming plate 5 in the axial direction 7, wherein a support pin 11 is able to be passed through at least one of the first openings 10 for the purpose of arrangement in the honeycomb structure 1 according to step c.

Figure 3:
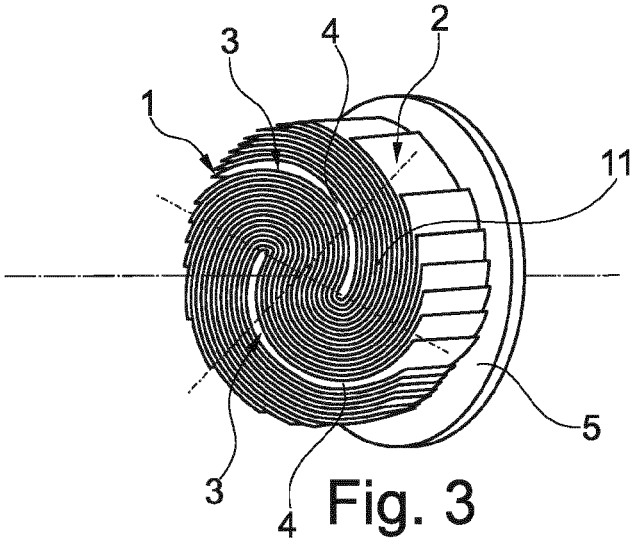
FIG. 3 shows a honeycomb structure and a forming plate in a perspective view.

FIG. 3 shows a forming plate 5 and a honeycomb structure 1 arranged thereon in a perspective view, and method step c. Here, the first web structure 8 extends in the axial direction 7 with constant height. Here, the first honeycomb structure 1 comprises a plurality of at least partially structured metal foils 2, wherein, in subregions 3 of the honeycomb structure 1, individual metal foils 2 are arranged spaced apart from an adjacently arranged metal foil 2 so as to be electrically insulated by an air gap 4.

In this state, in a further step d., the forming plate 5 is sent, together with the at least one metal foil 2, to a connection step in which interconnection of the at least one metal foil 2 is realized for the permanent formation of the honeycomb structure 2.

Figure 4:
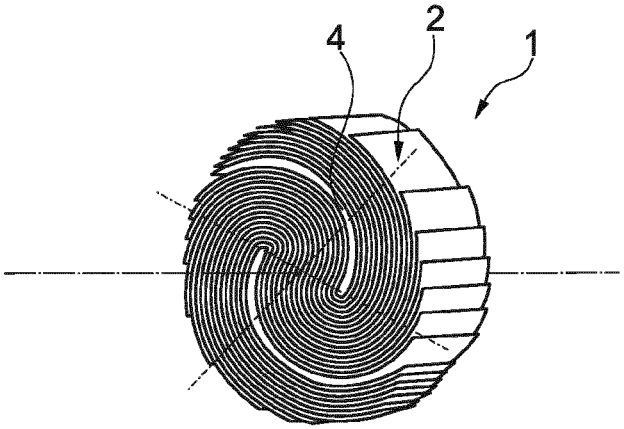
FIG. 4 shows a honeycomb structure in the finished state with an air gap in a perspective view.

FIG. 4 shows a honeycomb structure 1 in the finished state with an air gap 4 in a perspective view. In step e., the forming plate 5 with the first web structure 8 has been removed from the honeycomb structure 1.

Figure 5:
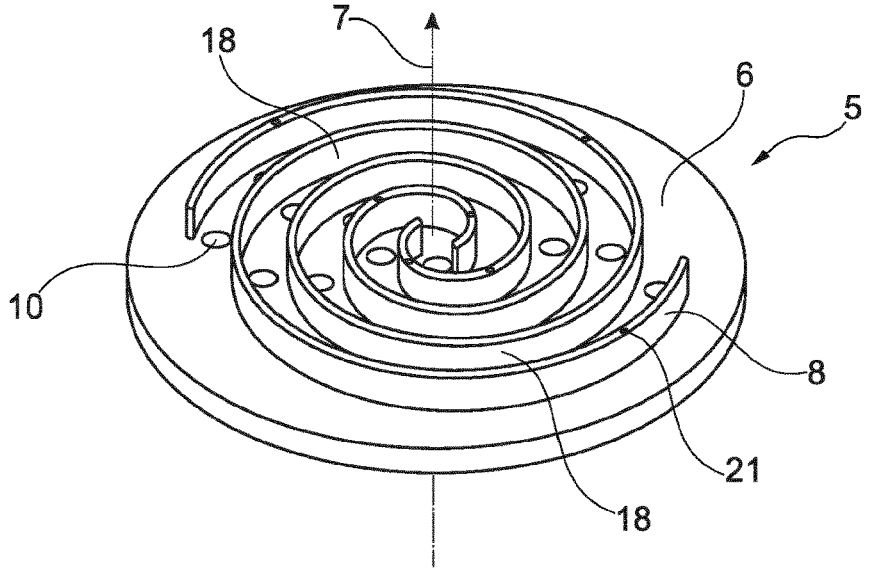
FIG. 5 shows a second forming plate in a perspective view.

FIG. 5 shows a second forming plate 5 in a perspective view. The statements made regarding FIG. 2 apply correspondingly. Provided here likewise is a plurality of first openings 10, which extend through the forming place 5 in the axial direction 7. The first web structure 8 comprises multiple windings 18 and furthermore has second openings 21 into which driving pins 20 of the winding spiral 12 can extend (see FIG. 6).

Figure 6:
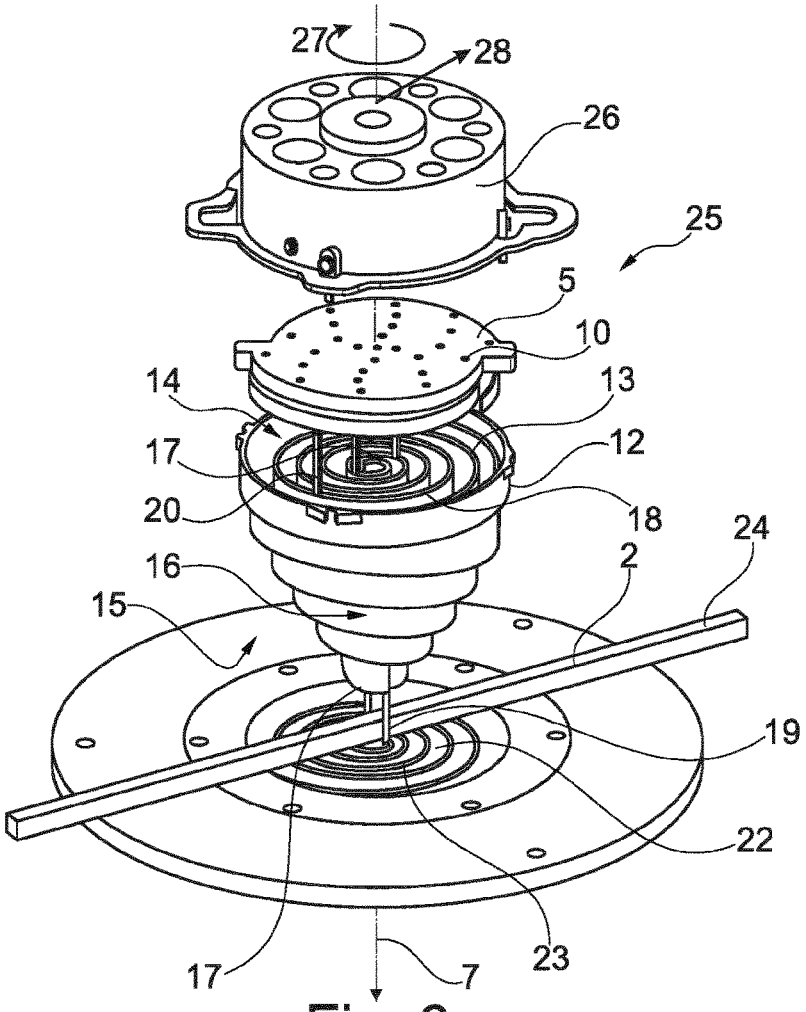
FIG. 6 shows a winding device in an exploded illustration and perspective view.

FIG. 6 shows a winding device 25 in an exploded illustration and perspective view. The winding device 25 shown here is used in step c. of the method. The winding device 25 comprises a receiving part 26 drivable at least in one circumferential direction 27. The winding device 25 further comprises a forming plate 5, a winding spiral 12 and a winding plate 22.

The winding spiral 12 has a spiral-shaped second web structure 13, which corresponds to the first web structure 8 on the forming plate 5, wherein the second woo structure 13 terminates in a flush manner in the axial direction 7 at a first end side 14 facing the forming plate 5, wherein the second web structure 13 has a pitch 16 at the second end side 15. Proceeding from a center 17 of the second web structure 13, the second end side 15 continuously approaches the first end side 13 along the spiral-shaped windings 18, wherein the winding spiral 12 has at least two pins 19, which extend further along the axial direction 7 proceeding from the center 17. The stack 24 of metal foils 2 is received between the two pins 19 and, by rotation of the winding spiral 12, continuously received into the second web structure 13 and then transferred into the first web structure 8.

The winding spiral 12 thus allows automated arrangement of the at least one metal foil 2 in the first web structure 8. Proceeding from a first end side 14 of the winding spiral 12, which aide faces the forming plate 5 and the first web structure 8 arranged thereon, a second web structure 13 extends in a spiral-shaped manner, on the one hand along a circumferential direction 27 and in a radial direction 28 from the outside inward, and on the other hand with each winding 18 in the axial direction 7 too. Here, the complete second web structure 13 terminates in a flush manner at the first end side 14, wherein the second web structure 13 extends with a pitch 16 progressively along the axial direction 7 at the second end side 15, with the result that a center 17 at the second end side 15 of the second web structure is arranged at a maximum distance from the first end side 14. The pitch 16 of the spiral second web structure 13 makes it possible that, during rotation of the winding spiral 12, the one metal foil 2 (or the stack 24 of metal foils 2) is gradually wound in a spiral proceeding from the center 17, and an increasing number of windings 18 (proceeding from an innermost winding 18 at the center 17 to an outermost winding 18) are received in the second web structure 13.

In this case, the second web structure 13 likewise forms the predetermined air gaps 4 in the honeycomb structure 1. The second web structure 13 corresponds at least substantially to the form of the first web structure 8 (in a plane 9 transverse to the axial direction 7). Consequently, the at least one metal foil 2 can be transferred from the winding spiral 12 into the first web structure 8 of the forming plate 5 along the axial direction 7, and the winding spiral 12 can continue to be used for the next winding process.

Here, the winding spiral 12 has driving pins 20 which extend from the second web structure 13 at the first end side 14 in the axial direction 7 and which extend into second openings 21 in the first web structure 8 and/or in the forming place 5 and/or into first openings 10 in the forming plate 5.

The driving pins 20 ensure an aligned arrangement of the first web structure 8 and the second web structure 13. Furthermore, it is thus possible to couple the rotational movement of the receiving part 26, forming plate 5 and winding spiral 12 for winding the at least one metal foil 2.

Also shown here is a winding plate 22 which has a slot 23 that extends in a spiral-shaped manner and corresponds to the second web structure 13. During the rotation of the winding spiral 12, the winding spiral 12 sinks into the slot 23 with the second web structure 13 and starting with the center 17, and thus gradually transfers, along the axial direction 7, the at least one metal foil 2, arranged between the winding plate 22 and the winding spiral 12, into the winding spiral 12 and, finally, into the first web structure 8.

The winding plate 22 is of planar form here, with the result that the at least one metal foil 2 is guided substantially in its entire extent along the axial direction 7.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for producing a honeycomb structure (1) having at least one at least partially structured metal foil (2), such that, in subregions (3) of the honeycomb structure (1), a portion of the at least one metal foil (2) is arranged spaced apart from an adjacently arranged portion of the at least one metal foil (2) so as to be electrically insulated by an air gap (4) therebetween, the method comprising:

providing the at least one metal foil (2);

providing a forming plate (5) having a bearing surface (6) and having at least one first web structure (8) extending from the bearing surface (6) in an axial direction (7), the first web structure (8) extending in a plane (9) parallel to the bearing surface (6) and defining the air gap (4) to be produced in the honeycomb structure (1); and arranging the at least one metal foil (2) on the bearing surface (6) in the first web structure (8).

2. The method as claimed in claim 1, further comprising:

connecting the forming plate (5) to the at least one metal foil (2), so as to interconnect the at least one metal foil (2) for permanent formation of the honeycomb structure (1); and then removing the forming plate (5) having the first web structure (8) from the honeycomb structure (1).

3. The method as claimed in claim 2, wherein the connecting step comprises soldering.

4. The method as claimed in claim 1, wherein the forming plate (5) has a plurality of first openings (10) extending through the forming plate (5) in the axial direction (7), wherein a support pin (11) is passable through at least one of the first openings (10) to as to arrange the honeycomb structure (1) according to the arranging step.

5. The method as claimed in claim 1, wherein, in the arranging step, use is additionally made of a winding spiral (12) having a spiral-shaped second web structure (13) that corresponds to the first web structure (8), wherein the second web structure (13) terminates in a flush manner in the axial direction (7) at a first end side (14) facing the forming plate (5), wherein the second web structure (13) has a pitch (16) at the second end side (15), wherein, proceeding from a center (17) of the second web structure (13), the second end side (15) continuously approaches the first end side (14) along the spiral-shaped windings (18), and wherein the winding spiral (12) has at least two pins (19), which extend further along the axial direction (7) proceeding from the center (17), the arranging step further comprising:

receiving the at least one metal foil (2) between the at least two pins (19);

continuously receiving, by rotation of the winding spiral (12), the at least one metal foil (2) into the second web structure (13); and then transferring the at least one metal foil (2) into the first web structure (8).

6. The method as claimed in claim 5, wherein the winding spiral (12) has driving pins (20) extending from the second web structure (13) at the first end side (14), the driving pins (20) extending into second openings (21) in the first web structure (8) and/or in the forming plate (5) and/or into first openings (10) in the forming plate (5).

7. The method as claimed in claim 6, wherein, in the arranging step, use is also made of a winding plate (22) having a slot (23) extending in a spiral-shaped manner and corresponding to the second web structure (13), wherein, during the rotation of the winding spiral (12), the winding spiral (12) sinks into the slot (23) with the second web structure (13) and starting with the center (17), and thus the at least one metal foil (2), arranged between the winding plate (22) and the winding spiral (12), is, along the axial direction (7), gradually introduced into the winding spiral (12) and then transferred into the first web structure (8).

8. The method as claimed in claim 1, wherein, prior to being arranged in the first web structure (8), the at least one at least partially structured metal foil (2) forms a multi-layered stack (24).

9. A winding device (25) for implementing the method as claimed in claim 1, comprising:

the forming plate (5) having the first web structure (8).

10. The winding device (25) as claimed in claim 9, wherein the winding device (25) further comprises:

at least one winding spiral (12) having a second web structure (13), and a winding plate (22).

* * * * *